US010633933B2

(12) United States Patent
Moyes

(10) Patent No.: US 10,633,933 B2
(45) Date of Patent: Apr. 28, 2020

(54) CONNECTION APPARATUS

(71) Applicant: XTREME WELL TECHNOLOGY LIMITED, Banchory (GB)

(72) Inventor: Peter Moyes, Banchory (GB)

(73) Assignee: XTREME WELL TECHNOLOGY LIMITED, Glassel (GB)

( * ) Notice: Subject to any disclaimer, the term of this patent is extended or adjusted under 35 U.S.C. 154(b) by 583 days.

(21) Appl. No.: 15/121,133

(22) PCT Filed: Feb. 19, 2015

(86) PCT No.: PCT/GB2015/050481
§ 371 (c)(1),
(2) Date: Aug. 24, 2016

(87) PCT Pub. No.: WO2015/124933
PCT Pub. Date: Aug. 27, 2015

(65) Prior Publication Data

US 2017/0009533 A1 Jan. 12, 2017

(30) Foreign Application Priority Data

Feb. 24, 2015 (GB) ..... 1403162.9

(51) Int. Cl.
*E21B 17/02* (2006.01)
*E21B 23/02* (2006.01)
*E21B 31/20* (2006.01)

(52) U.S. Cl.
CPC ..... *E21B 17/02* (2013.01); *E21B 23/02* (2013.01); *E21B 31/20* (2013.01)

(58) Field of Classification Search
CPC ..... E21B 17/06; E21B 17/043; E21B 17/046; E21B 23/02
See application file for complete search history.

(56) References Cited

U.S. PATENT DOCUMENTS 2,862,560 A * 12/1958 Bostock ..... E21B 23/02 166/125
3,100,533 A * 8/1963 Fredd ..... E21B 23/006 166/125

(Continued)

FOREIGN PATENT DOCUMENTS

GB 2119426 B * 11/1985 ..... E21B 23/02
WO 2014077800 A1 5/2014

OTHER PUBLICATIONS

International Search Report and Written Opinion issued in the related PCT Application PCT/GB2015/050481, dated Jun. 19, 2015 (9 pages).

(Continued)

*Primary Examiner* — Matthieu F Setliff
(74) *Attorney, Agent, or Firm* — Eileen Pape

(57) ABSTRACT

A releasable connector apparatus is provided for permitting a releasable connection with an object. The apparatus comprises a connector assembly which includes a connector member moveable between connection and disconnection configurations to facilitate a releasable connection with an object. A connector mandrel comprising a support surface is movable relative to the connector assembly such that alignment of the support surface and the connector member locks said connector member in its connected configuration, and misalignment of the support surface and the connector member permits the connector member to be moved towards its disconnected configuration. A limit arrangement of the apparatus is configurable from an activated state in which movement of the connector mandrel is limited to a first range of movement over which alignment of the support surface with the connector member is maintained, to a deactivated state in which movement of the connector mandrel is permitted beyond the first range of movement to allow (Continued)

misalignment of the support surface and the connector member.

40 Claims, 6 Drawing Sheets

(56) References Cited

U.S. PATENT DOCUMENTS

| | | | | | |
|---|---|---|---|---|---|
| 4,295,528 | A | * | 10/1981 | Carmody | E21B 23/02 166/217 |
| 4,778,008 | A | * | 10/1988 | Gonzalez | E21B 17/06 166/242.6 |
| 4,944,345 | A | * | 7/1990 | Mashaw, Jr. | E21B 23/02 166/206 |
| 5,074,362 | A | * | 12/1991 | Allwin | E21B 23/01 166/208 |
| 2011/0146988 | A1 | | 6/2011 | McGlothen | |
| 2011/0163560 | A1 | | 7/2011 | Manke et al. | |

OTHER PUBLICATIONS

International Preliminary Report on Patentability issued in the related PCT Application PCT/GB2015/050481, dated Aug. 30, 2016 (7 pages).
Search Report issued in the related GB application 1403162.9, dated Sep. 17, 2014 (3 pages).
Examination Report issued in the related AU application 2015220552, dated Aug. 14, 2018 (4 pages).

* cited by examiner

CONNECTION APPARATUS

This application is the U.S. national phase of International Application No. PCT/GB2015/050481 filed 19 Feb. 2015, which designated the U.S. and claims priority to GB Patent Application No. 1403162.9 filed 24 Feb. 2014, the entire contents of each of which are hereby incorporated by reference.

FIELD OF THE INVENTION

The present invention relates to an apparatus for use in establishing a connection with an object, such as an object which is or is to be located within a wellbore.

BACKGROUND TO THE INVENTION

In the oil and gas industry tool connections are frequently used. For example, a downhole tool may be required to be secured to a deployment member, such as wireline or coiled tubing and be deployed into a wellbore to perform a desired function, such as sealing, data acquisition, flow control, production enhancement or the like. The downhole tool may be connected with one or more other tools to form a tool string. Such a tool string may include a tool which functions to operate the connected downhole tool. For example, the tool string may include a setting tool which is used to operate or actuate the downhole tool.

Also, in some instances a connection may need to be made with a tool already located within a wellbore, such as when a previously deployed tool is to be retrieved or where a tool may require to be fished from the well, for example following a failure, being accidentally dropped into the wellbore, and the like.

Many tool connections include a fail-safe release which can be activated to release the connection in certain circumstances. Such a fail safe may include sharable connections, for example, which may shear upon application of a predetermined force, such as axial force.

In the mechanical setting of a downhole tool, an overload safety may be provided in an associated setting tool, and in the event of activation of such an overload safety a recoil or jarring force may inadvertently activate a failsafe release in a connector holding the tool, causing disconnection of the tool and potentially dropping this through the wellbore.

Also, in some fishing operations it might be desirable to apply a jarring force to the downhole tool being retrieved, for example via a separate jarring tool coupled to or forming part of a fishing tool. In some cases the effect of a jarring tool may inadvertently release the connection between the fishing tool and downhole tool.

SUMMARY OF THE INVENTION

According to an aspect of the present invention there is provided a releasable connector apparatus, comprising:

a connector assembly including a connector member which is moveable between connection and disconnection configurations to facilitate a releasable connection with an object;

a connector mandrel comprising a support surface and being movable relative to the connector assembly such that alignment of the support surface and the connector member locks said connector member in its connected configuration, and misalignment of the support surface and the connector member permits the connector member to be moved towards its disconnected configuration; and a limit arrangement configurable from an activated state in which movement of the connector mandrel is limited to a first range of movement over which alignment of the support surface with the connector member is maintained, to a deactivated state in which movement of the connector mandrel is permitted beyond the first range of movement to allow misalignment of the support surface and the connector member.

In use, the connector apparatus may be appropriately arranged relative to an object and connection with the object achieved via the connector member when positioned or permitted to be positioned within its connection configuration. Such a connection may be maintained by the connector mandrel, and specifically by alignment of the support surface of the connector mandrel with the connector member. During such connection the limit arrangement permits the connector mandrel to be moved relative to the connector member over the first range of movement while the support surface of the connector mandrel remains aligned with the connector member, thus maintaining the connection. However, when disconnection is required, the limit arrangement is configured in its deactivated state to allow the connector mandrel to move beyond the first range of movement and misalign the support surface and the connector member. Such misalignment has the effect of desupporting the connector member and permitting this connector member to be moved to its disconnection position and allow disconnection from the object.

As noted above, when activated, the limit arrangement permits the connector mandrel to be moved over the first range of movement while maintaining support to the connector member and thus maintaining connection with an object. Such ability to maintain the connection and at the same time allow movement of the connector mandrel may provide enhanced utility beyond providing the connection.

For example, in some circumstances the permitted movement within the first range of movement may be used to apply a jarring force to a connected object, without risk, or with minimal risk of the connection with the object becoming released during such jarring. Such an arrangement may have application, although not limited application, during fishing operations, in which the connector apparatus is used to connect with an object requiring to be retrieved from a wellbore.

The ability to permit movement of the connector mandrel within the first range of movement while maintaining the connection with an object may also permit the connector apparatus to suitably react to an external stimulus without necessarily releasing the connection with the object. For example, in the event of a force, such as a recoil force being applied between the connector apparatus and a connected object, the permitted movement of the connector mandrel may permit such a force, or at least a portion of such a force, to be absorbed, without or with minimal risk of the connection with the object being inadvertently released. For example, a setting tool may be used to establish a force on a connected object, wherein in the event of rapid setting of a tool, activation of an overload or safety system or the like, any resulting recoil or impulse force may be absorbed or at least partially absorbed by movement of the connector mandrel within the first range of movement, while maintaining the connection with the object.

Furthermore, the ability to achieve movement within the first range may permit such movement to be used to actuate an associated tool, system, process or the like. For example, the connector mandrel may be connected, directly or indirectly, to a further object, such as a tool or the like, such that movement of the connector mandrel within the first range of movement may facilitate actuation of the further object.

The connector mandrel may be movable linearly relative to the connector assembly. In such an arrangement the first range of movement may include movement in a linear direction. The connector mandrel may additionally, or alternatively, be movable rotationally relative to the connector assembly. In such an arrangement the first range of movement may include movement in a rotational direction.

The connector mandrel may be movable relative to the connector assembly in a single direction of movement. In such an arrangement the connector mandrel may be movable in said single direction of movement to cause the support surface of the connector mandrel and the connector member to become misaligned, when the limit arrangement is deactivated. Further, when the limit arrangement is activated movement of the connector mandrel in this single direction may be limited.

The connector mandrel may be movable relative to the connector assembly in multiple directions of movement. In some embodiments the connector mandrel may be configured to move relative to the connector assembly in reverse or opposing directions of movement, for example in a reciprocating manner.

Where the connector mandrel is movable in multiple directions of movement, the connector mandrel may be movable in one of said multiple directions of movement to cause the support surface of the connector mandrel and the connector member to become misaligned, when the limit arrangement is deactivated. The connector mandrel may be movable in more than one of said multiple directions of movement to cause the support surface of the connector mandrel and the connector member to become misaligned, when the limit arrangement is deactivated.

Where the connector mandrel is movable in multiple directions of movement, and when the limit arrangement is activated, movement of the connector mandrel in one of the multiple directions may be limited. Alternatively, where the connector mandrel is movable in multiple directions of movement and when the limit arrangement is activated, movement of the connector mandrel in multiple directions may be limited.

The limit arrangement, when activated, may limit movement of the connector mandrel relative to the connector assembly in at least one direction. This at least one direction may include a direction in which the connector mandrel is required to be moved to misalign the support surface and connector member. In some embodiments the limit arrangement may limit movement of the connector mandrel relative to the connector assembly in multiple directions, for example in two opposing directions.

The limit arrangement may be deactivated to permit movement of the connector mandrel in a single direction beyond the first range of movement. This single direction preferably includes a direction in which the connector mandrel is moved relative to the connector assembly to achieve misalignment of the mandrel support surface and the connector member.

Alternatively, the limit arrangement may be deactivated to permit movement of the connector mandrel in more than one direction, for example opposing directions, beyond the first range of movement.

The limit arrangement may be configurable from its activated state to its deactivated state following a predetermined sequence of movement of the connector mandrel within the first range of movement.

In such an arrangement the ability to release a connection with an object relies on firstly performing the predetermined sequence of movement of the connector mandrel. This may assist to minimise or eliminate inadvertent or unintentional release of the connection with an object. That is, disconnection will only be permitted following a deliberate manipulation of the connector apparatus to follow the predetermined sequence of movement of the connector mandrel. Following such a deliberate sequence of movement of the connector mandrel, the limit arrangement may become deactivated, and the connector mandrel then permitted to move beyond the first range of movement to misalign the support surface of the connector mandrel and the connector member, allowing the connector member to be moved to its retracted position and facilitate release of the connection with the object.

The connector mandrel may provide a functional operation during the predetermined sequence of movement to deactivate the limit arrangement. For example, during the predetermined sequence of movement the connector mandrel may function within a jarring operation, absorbing or accommodating an applied force, actuating a further object, or the like.

The predetermined sequence of movement may include movement in a linear direction. The predetermined sequence of movement may alternatively, or additionally, include movement in a rotational direction.

The predetermined sequence of movement of the connector mandrel to permit reconfiguration of the limit arrangement to its deactivated state may include movement in a single direction within or over the first range of movement.

The predetermined sequence of movement of the connector mandrel to permit reconfiguration of the limit arrangement to its deactivated state may include movement in multiple directions within or over the first range of movement.

In some embodiments the predetermined sequence of movement of the connector mandrel to permit reconfiguration of the limit arrangement to its deactivated state may include movement in reverse directions. For example, the predetermined sequence of movement may include one or a series of reciprocating movements of the connector mandrel.

The predetermined sequence of movement may include a sequence of individual discrete movements. The predetermined sequence of movement may include at least two sequential discrete movements in a common direction. The predetermined sequence of movement may include at least two sequential discrete movements in reverse directions. In one embodiment the predetermined sequence of movement may include multiple sequential discrete movements in reverse directions.

The apparatus may be adjustable such that the required number of discrete movements within the predetermined sequence is adjustable.

The apparatus may be adjustable such that the first range of movement is adjustable. In some embodiments adjusting the permitted first range of movement may also provide adjustment to the required number of discrete movements within the predetermined sequence.

The limit arrangement may comprise an abutment member configured to physically limit movement of the connector mandrel within the first range of movement. In use, the connector mandrel may abut, for example directly or indirectly abut, the abutment member to thus limit movement of the connector mandrel within the first range.

The abutment member may be provided as a unitary component. Alternatively, the abutment member may comprise multiple components.

In some embodiments the abutment member may be generally annular or ring-shaped and mounted coaxially relative to the connector mandrel.

The abutment member may be secured at a fixed location when the limit arrangement is activated. The abutment member may be released from the fixed location to deactivate the limit arrangement. In such an arrangement the abutment member may be released from the fixed location following a predetermined sequence of movement of the connector mandrel.

The abutment member may be mounted relative to the connector assembly. The abutment member may be mounted on the connector assembly. The abutment member may be rigidly fixed to the connector assembly when the limit arrangement is activated, and released from the connector assembly to deactivate the limit arrangement. The abutment member may remain mounted on or within the connector assembly when released. For example, the abutment member may be permitted to slide relative to the connector assembly when said abutment member is released. The abutment member may be arranged to slide relative to the connector assembly over a distance which permits the connector mandrel to move beyond the first range of movement. Such sliding movement may be achieved in the same direction the connector mandrel is moved to misalign the support surface and connector member.

The apparatus may comprise a limit mandrel, upon which the abutment member is mounted. The limit mandrel may be secured to or form part of the connector assembly. The limit mandrel may be generally sleeve shaped. The limit mandrel may be coaxially mounted relative to the connector mandrel. The abutment member may be coaxially mounted relative to the limit mandrel.

The connector mandrel may directly abut the abutment member. Alternatively, the connector mandrel may indirectly abut the abutment member. For example, the apparatus may further comprise a limit sleeve coupled to the connector mandrel, wherein the limit sleeve abuts the abutment member. An end face of the limit sleeve may be arranged to abut the abutment member. In one embodiment the limit sleeve may be coaxially mounted relative to the connector mandrel. The connector assembly may be radially interposed between the connector mandrel and the limit sleeve. The limit sleeve and connector mandrel may be concentrically mounted relative to each other with an annular gap defined therebetween, wherein the connector assembly is received within this annular gap. One end of the connector assembly may be received within said annular gap.

The limit sleeve may be adjustable, for example adjustable relative to the connector mandrel, to provide for adjustment of the first range of movement.

The limit arrangement may comprise at least one locking member configured to engage the abutment member and secure said abutment member at a fixed location when the limit arrangement is activated. The at least one locking member may be configured to disengage the abutment member to deactivate the limit arrangement and permit the abutment member to be released from the fixed location. The at least one locking member may be radially movable to disengage the abutment member.

The abutment member may be mounted on one radial side of the connector assembly, for example on one radial side of a limit mandrel, and the at least one locking member may extend through the connector assembly, for example through a limit mandrel, from an opposing radial side of the connector assembly. In such an arrangement the at least one locking member may be radially movable through the connector assembly to engage and disengage the abutment member.

The apparatus may comprise a support member movable from a supporting position in which the at least one locking member is supported and held in engagement with the abutment member, to a desupporting position in which the at least one locking member is unsupported and permitted to disengage the abutment member. Thus, when the support member is in the supporting position the limit arrangement may be activated, and when the support member is in the desupporting position the limit arrangement may be deactivated.

The support member may be configured to radially support and desupport the at least one locking member.

The support member may be generally sleeve shaped. The support member may be coaxially mounted relative to the abutment member. The support member may be coaxially mounted relative to the connector mandrel. At least a portion of the support member may be radially interposed between the connector mandrel and the abutment member. The support member may be coaxially mounted relative to the connector assembly, for example coaxially mounted relative to a limit mandrel of the connector assembly. In one embodiment at least a portion of the support member may be radially interposed between the connector mandrel and the connector assembly, for example a limit mandrel of the connector assembly.

The support member may be axially movable between the supporting and desupporting positions.

The apparatus may be configured such that the support member is moved from the supporting position to the desupporting position by a predetermined sequence of movement of the connector mandrel. Such a predetermined sequence of movement of the connector mandrel may drive the support sleeve towards its desupporting position. The support member may be moved or driven in discrete steps from the supporting position to the desupporting position by a predefined sequence of movement of the connector mandrel.

The predetermined sequence of movement of the connector mandrel may include at least two sequential discrete movements in reverse directions, wherein the apparatus is configured such that the support member is moved or driven one discrete step only in response to movement of the connector mandrel in one of the reverse directions. That is, movement of the connector mandrel in one direction will cause the support member to move a discrete step towards the desupporting position, and movement of the connector mandrel in an opposite direction will not cause any, or will only cause minimal, movement of the support member.

The connector mandrel and the support member may be coupled together via a uni-directional coupling arrangement. The uni-directional coupling arrangement may be configured to permit the support sleeve to be moved only in response to movement of the connector mandrel in one direction. The uni-directional coupling arrangement may couple the support member to the connector mandrel when the connector mandrel is moved in a first direction, and decouple the support member from the connector mandrel when the connector mandrel is moved in a second direction. The second direction may be opposite the first direction. In such an arrangement, movement of the connector mandrel in the first direction will also cause movement of the support member in said first direction.

The apparatus may comprise a ratchet arrangement. The ratchet arrangement may define a uni-directional coupling arrangement.

The ratchet arrangement may comprise a first ratchet assembly for providing a ratchet connection between the support sleeve and the connector mandrel. The first ratchet assembly may rigidly or drivingly couple the connector mandrel and the support sleeve together when the connector mandrel is moved in a first direction, and uncouple the connector mandrel and the support member when the connector mandrel is moved in a second direction. The first ratchet assembly may provide a direct ratchet connection between the support sleeve and the connector mandrel. Alternatively, the first ratchet assembly may provide an indirect ratchet connection between the support sleeve and the connector mandrel. For example, the first ratchet assembly may provide a ratchet connection with a limit sleeve which is coupled to the connector mandrel. In such an arrangement the limit sleeve may also define a ratchet sleeve.

The first ratchet assembly may comprise at least one ratchet member associated with one of the support sleeve and the connector mandrel, and a ratchet profile associated with the other of the support sleeve and the connector mandrel, wherein the ratchet member and ratchet profile are configured to interengage. In one embodiment the at least one ratchet member is mounted on the support sleeve, and the ratchet profile is associated with the connector mandrel. The ratchet profile may be provided on a limit sleeve which is secured to the connector mandrel.

The ratchet arrangement may comprise a second ratchet assembly for providing a ratchet connection between the support sleeve and the connector assembly. The second ratchet assembly may comprise at least one ratchet member associated with one of the support sleeve and the connector assembly, and a ratchet profile associated with the other of the support sleeve and the connector assembly, wherein the ratchet member and ratchet profile are configured to interengage. In one embodiment the at least one ratchet member is mounted on the connector assembly, and the ratchet profile is provided on the support sleeve.

The first and second ratchet assemblies may be configured to operate in reverse directions. Such an arrangement may permit discrete movement steps of the support sleeve to be achieved by movement of the connector mandrel in a single direction. That is, when the connector mandrel is moved in a first direction the first ratchet assembly uncouples the connector mandrel from the support sleeve to permit relative movement therebetween, while the second ratchet assembly couples the support sleeve to the connector assembly to prevent relative movement therebetween. Further, when the connector mandrel is moved in a second, reverse direction, the first ratchet assembly couples, in particular drivingly couples, the connector mandrel to the support member such that movement of connector mandrel drives the support sleeve, while the second ratchet assembly uncouples the support sleeve from the connector assembly to permit relative movement therebetween. Such permitted relative movement between the support sleeve and the connector assembly may facilitate movement of the support sleeve by movement of the connector mandrel to allow the support sleeve to be advanced towards its desupporting position.

The support member may be biased, for example spring biased, in one direction. The support member may be spring biased to oppose motion of the support member towards its unsupporting position. Such bias may assist to prevent undesired movement of the support sleeve while being driven by the connector mandrel. Such a bias may provide a preloading on the support sleeve.

The connector mandrel and support sleeve may be initially coupled together by a releasable connection. Such a releasable connection may comprise one or move shear screws or the like. Such a releasable connection may be configured to be released by application of a predetermined force via the connector mandrel.

The apparatus may comprise a locking arrangement configured to lock the connector mandrel relative to the connector assembly when the connector mandrel has moved beyond, for example a predetermined distance beyond, the first range of movement following deactivation of the limit arrangement. The locking arrangement may comprise a snap ring, for example.

The connector member may be radially movable between extended and retracted configurations or positions.

In some embodiments the connector member may be movable radially inwardly towards its retracted configuration. In such embodiments the connector member may facilitate a releasable connection with an object located radially outwardly of the connector member. Furthermore, in such embodiments the connector mandrel may be located radially inwardly of the connector member.

In some embodiments the connector member may be movable radially outwardly towards its retracted configuration. In such embodiments the connector member may facilitate a releasable connection with an object located radially inwardly of the connector member. Furthermore, in such embodiments the connector mandrel may be located radially outwardly of the connector member.

The connector mandrel may be arranged coaxially relative to the connector assembly. In some embodiments the connector mandrel may be coaxially mounted radially within the connector assembly. In other embodiments the connector mandrel may be coaxially mounted radially outwardly of the connector assembly.

The connected configuration of the connector member may be achieved when said connector member is in an extended position or configuration.

The disconnected configuration of the connector member may be achieved when said connector member is in a retracted position or configuration.

The connector assembly may comprise a plurality of connector members, each movable between connection and disconnection configurations.

The connector mandrel may define a support surface configured to engage multiple connector members. The connector mandrel may define a single support surface configured to engage each of a plurality of connector members. The connector mandrel may define multiple support surfaces each configured to engage one or more of a plurality of connector members.

In some embodiments the connector assembly may comprise a plurality of circumferentially arranged connector members. In such an arrangement the connector mandrel may define a circumferential support surface, or multiple support surfaces arranged circumferentially around the connector mandrel.

In some embodiments the connector assembly may comprise a plurality of axially arranged connector members.

The connector member may define a profile configured to be engaged with a corresponding profile formed in or on an object to which a releasable connection is desired. When the connector member is locked within its connection configuration by alignment with the support surface of the connector mandrel, interengagement of the profiled connector member with a profile formed in or on an object may facilitate connection with said object. In some embodiments when the support surface of the connector mandrel and the connector member are misaligned, interengagement of the respective profiles of the connector member and the object while the apparatus is moved in a disconnection direction may cause the connector member to be deflected towards its disconnection configuration and allow disconnection of the apparatus from the object.

The connector member may comprise one or more slips, dogs, barbs, or the like.

The connector assembly may comprise a connector sleeve associated with the connector member. The connector sleeve may be configured to support the connector member. The connector sleeve may be configured to guide the connector member during movement between its connection and disconnection configurations.

The connector member may be separately formed and mounted relative to the connector sleeve. The connector member may be integrally formed with the connector sleeve.

In one embodiment the connector member may extend radially though a slot formed in the connector sleeve, and be moved between connection and disconnection configurations within and/or through this slot. The slot may be defined by an aperture extending through a wall of the connector sleeve. The slot may be defined between castellations or the like formed in the connector sleeve.

The connector member may comprise a proximal end coupled to the connector sleeve, and a free distal end. In such an arrangement deflection of the connector member may permit the distal end to be moved between connection and disconnection configurations. In such an arrangement the support surface of the connector mandrel may be configured to be aligned with at least a distal end region of the connector member to lock said connector member in its extended configuration.

The connector member may comprise a profiled portion located on a distal end region thereof. Such a profiled portion may be configured to engage a corresponding profiled portion of an object to which a releasable connection is desired.

The connector member may define or comprise a collet finger. In such an arrangement the connector member may form part of a collet. The connector assembly may comprise a collet, wherein the connector member defines a collet finger.

The connector member may be biased in a preferred direction. The connector member may be moved against this bias upon engagement with at least one of the connector mandrel and an object to which connection is required. In one embodiment the connector member may be biased towards a connection configuration. In such an arrangement the connector member may be moved against this bias upon engagement with an object to which connection is made. Such engagement with an object may include engagement while making a connection, and/or engagement while breaking a connection. In an alternative embodiment the connector member may be biased towards a disconnection configuration. In such an arrangement the connector member may be moved against this bias upon engagement with the support surface of the connector mandrel.

The connector member may be biased by a separate biasing arrangement which acts on or against the connector member. Such a biasing arrangement may comprise a spring arrangement or the like.

The connector member may be biased by its own elasticity. For example, the connector member may comprise an elastically deformable portion which, if elastically deformed and stressed, will tend to seek to return to its unstressed position.

The connector member may be biased in a desired direction within the connector assembly. In some embodiments the connector member and any associated connector sleeve may be biased in a desired direction within the connector assembly. The connector member may be biased in an axial direction within the connector assembly.

The connector assembly may comprise a connector body. The connector member, and any associated connector sleeve, may be mounted relative to the connector body. In one embodiment the connector member may be radially retained relative to the connector body. In one embodiment the connector member may be axially movable relative to the connector body, for example between axial limits of movement. Such axial limits of movement may be defined by the connector body. The connector member may be biased towards one axial limit of movement within the connector body, for example spring biased. In one embodiment the connector member may be movable against such a bias, for example upon engagement of the connector member with an object to which connection is desired. This movement against the bias may temporarily disengage or misalign the connector member from the support surface of the connector mandrel to permit said connector member to be moved, for example deflected, towards its retracted position and permit connection with the object to be achieved. Once appropriate relative positioning of the connector member with the object is achieved during connection, the bias force may return the connector member towards one axial limit of movement and realign the connector member with the support surface of the connector mandrel.

The connector mandrel may define a stepped region adjacent the support surface, wherein relative movement of the connector mandrel beyond the first range of movement may permit the stepped region to become aligned with the connector member, thus permitting the connector member to be moved towards its retracted position into the stepped region. The stepped region may be defined by a recess formed within the connector mandrel.

The connector mandrel may define an axial through bore. The throughbore may be configured to accommodate an elongate member therethrough. Such an elongate member may comprise a rod, cylinder or the like. Such an elongate member may extend through the connector mandrel to engage an object to which connection is made. In such an arrangement the elongate member may be used to operate the object, for example to actuate, manipulate or the like, the object. The elongate member may form part of a setting tool or the like.

The apparatus may be configured to be coupled to a deployment member, such as wireline, coiled tubing, a workstring or the like.

The apparatus may be configured to be connected to an object located within a wellbore. In such an arrangement the apparatus may be used to assist in retrieving or fishing such an object from the wellbore. During such a retrieving operation a jarring force or sequence of jarring forces may be required to be applied to the object, for example to assist to free the object is stuck. The ability to permit movement of the connector mandrel within the first range of movement while maintaining the connection with the object may assist to facilitate such jarring of the object.

The apparatus may be configured to deploy and subsequently release an object into a wellbore.

The apparatus may be configured for use in actuating, for example setting, an object within a wellbore. The ability to permit movement of the connector mandrel within the first range of movement while maintaining the connection with the object may permit the apparatus to accommodate any forces, or at least the effect of such forces, associated with such setting or actuation, for example recoil forces or the like.

According to another aspect of the present invention there is provided a method for releasing a connection between a connector apparatus and an object, comprising:

providing a limit arrangement of the connector apparatus in an activated state such that said limit arrangement limits movement of a connector mandrel of the connector apparatus to a first range of movement over which the connector mandrel supports a connector member in a connection configuration to maintain connection with an object; and reconfiguring the limit arrangement to a deactivated state to allow the connector mandrel to move beyond the first range of movement to desupport the connector member and allow said connector member to move towards a disconnected configuration to permit disconnection from the object.

The method may comprise moving the connector mandrel in a predetermined sequence of movement within the first range of movement to reconfigure the limit arrangement from its activated state to its deactivated state. In such an arrangement the ability to release a connection with an object relies on firstly performing the predetermined sequence of movement of the connector mandrel.

According to another aspect of the present invention there is provided an activator apparatus, comprising:

an activator mandrel moveable to provide an activation event; and a limit arrangement configurable from an activated state in which movement of the activator mandrel is limited to a first range of movement over which the activation event is not permitted, to a deactivated state in which movement of the activator mandrel is permitted beyond the first range of movement to provide the activation event.

The activation event may include activation of a tool, such as a downhole tool.

The activation event may include release of a connector. In such an arrangement the activator mandrel may define or comprise a connector mandrel.

The limit arrangement may be configurable from its activated state to its deactivated state following a predetermined sequence of movement of the activator mandrel within the first range of movement.

The predetermined sequence of movement of the activator mandrel to permit reconfiguration of the limit arrangement to its deactivated state may include movement in multiple directions within or over the first range of movement.

The predetermined sequence of movement of the activator mandrel to permit reconfiguration of the limit arrangement to its deactivated state includes movement in reverse directions.

The apparatus may be adjustable such that a required number of discrete movements within the predetermined sequence is adjustable.

The apparatus may be adjustable such that the first range of movement is adjustable.

The limit arrangement may comprise an abutment member for physically limiting movement of the activator mandrel within the first range of movement.

The abutment member may be annular or ring-shaped and mounted coaxially relative to the activator mandrel.

The abutment member may be secured at a fixed location when the limit arrangement is activated, and released from the fixed location to deactivate the limit arrangement.

The abutment member may be released from the fixed location following a predetermined sequence of movement of the activator mandrel.

The apparatus may comprise a limit mandrel upon which the abutment member is mounted.

The limit arrangement may comprise at least one locking member configured to engage the abutment member and secure said abutment member at a fixed location when the limit arrangement is in its activated state, and to disengage the abutment member to deactivate the limit arrangement and permit the abutment member to be released from the fixed location.

The abutment member may be located on one radial side of the limit mandrel, and the at least one locking member may extend through the limit mandrel from an opposing radial side of the limit mandrel to engage the abutment member.

The apparatus may comprise a support member movable from a supporting position in which the at least one locking member is supported and held in engagement with the abutment member, to a desupporting position in which the at least one locking member is unsupported and permitted to disengage the abutment member.

The support member may be movable between the supporting and desupporting positions by a predetermined sequence of movement of the activator mandrel.

The predetermined sequence of movement of the activator mandrel may include at least two sequential discrete movements in reverse directions. The apparatus may be configured such that the support member is moved or driven one discrete step only in response to movement of the activator mandrel in one of the reverse directions.

The activator mandrel and the support member may be coupled together via a uni-directional coupling arrangement configured to permit the support member to be moved only in response to movement of the activator mandrel in one direction.

The uni-directional coupling arrangement may couple the support member to the activator mandrel when the activator mandrel is moved in a first direction, and may decouple the support member from the activator mandrel when the activator mandrel is moved in a second direction which is opposite the first direction.

The uni-directional coupling arrangement comprises a ratchet arrangement.

The ratchet arrangement may comprise a first ratchet assembly for providing a ratchet connection between the support member and the connector mandrel for drivingly coupling the activator mandrel and the support member together when the activator mandrel is moved in a first direction, and uncouple the activator mandrel and the support member when the activator mandrel is moved in a second, opposite direction.

The ratchet arrangement may comprise a second ratchet assembly.

The first and second ratchet assemblies may operate in reverse directions to permit discrete movement steps of the support member to be achieved by movement of the activator mandrel in a single direction.

Further aspects of the present invention may relate to a method of using the apparatus according to any other aspect, for example to a method for connecting and disconnecting the apparatus according to any other aspect to/from an object.

Further aspects of the present invention may relate to a method for connecting to an object located within a wellbore using the apparatus according to any other aspect.

Further aspects of the present invention may relate to a method for setting an object located within a wellbore using the apparatus according to any other aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1A:
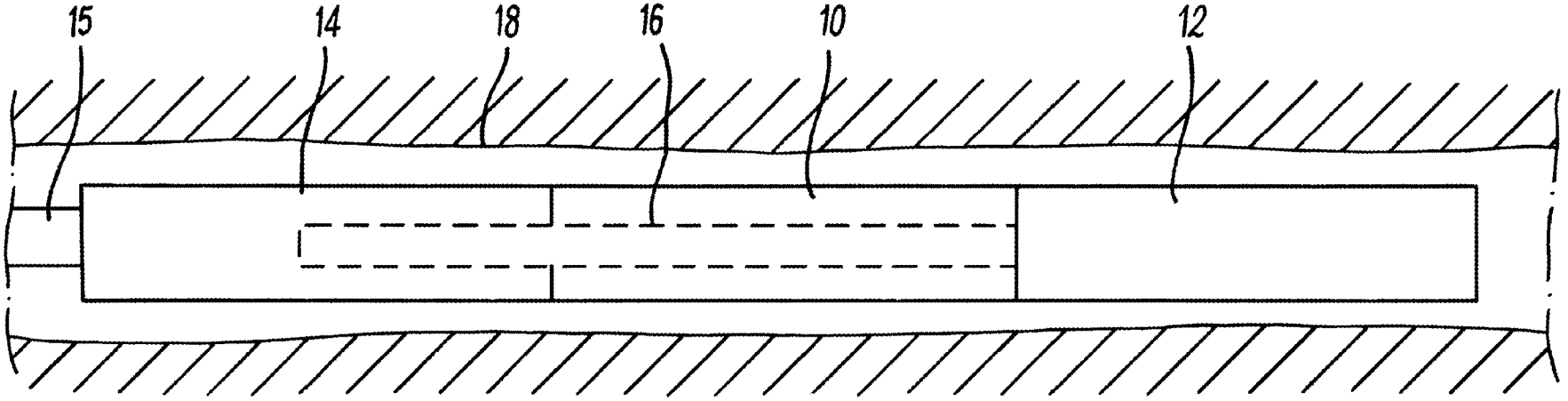
FIGS. 1A and 1B are diagrammatic illustrations of a releasable connector apparatus in accordance with an embodiment of the present invention, shown in sequential stages of operation within an exemplary application.
Figure 1B:
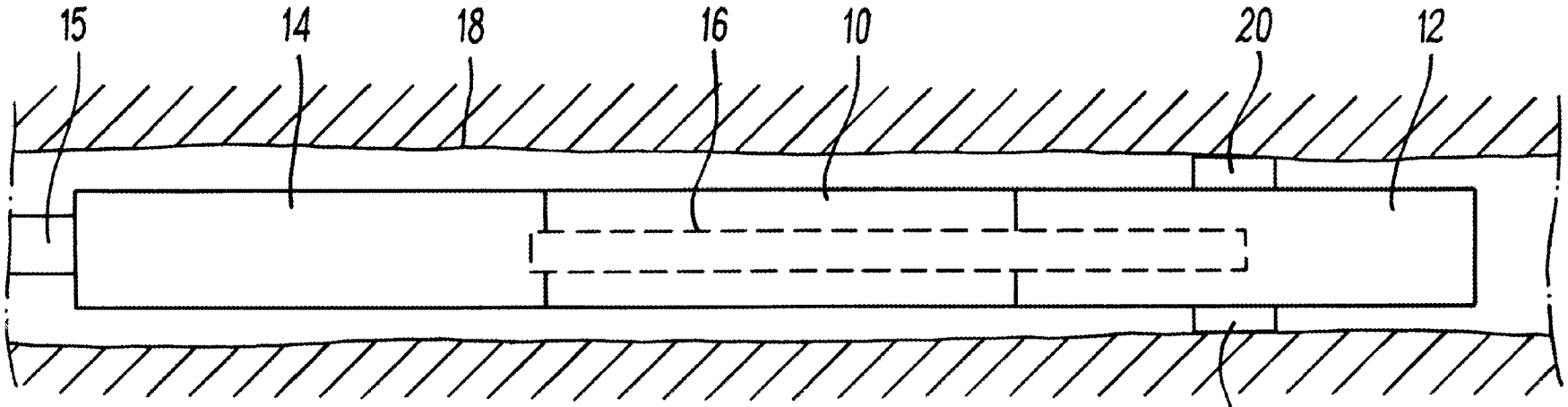

Aspects of the present invention relate to a releasable connector apparatus. Such an apparatus may have use in any application where a releasable connection with an object is required. Some applications may include use within a downhole environment. One such example is illustrated in FIGS. 1A and 1B, reference to which is now made. In this example one end of a releasable connector 10 according to any embodiment of the present invention is connected to an object, such as a downhole tool 12, and an opposite end is connected to a setting tool 14 which in turn is connected to coiled tubing 15 (or any other elongate deployment arrangement, such as wireline or the like). The setting tool 14 includes an actuator 16 (shown in broken outline) which extends through the connector 10 to engage the downhole tool 12.

As shown in FIG. 1A, the setting tool 14, connector 10 and downhole tool 12 are deployed into a wellbore 18 to the required depth. Once at the required depth the setting tool 14 may be actuated, as shown in FIG. 1B, to operate the downhole tool 12 via the actuator 16. In the specific example illustrated the setting tool 14 is used to extend slips 20 on the downhole tool 12 to engage the wall of the wellbore 18.

Known setting tools often include an overload relief system which may be activated to protect the setting tool 14 and downhole tool 12 from application of forces above a threshold level. In the event of overload, for example caused by failure of the slips 20 to extend, or upon engagement of the slips with the wall of the well bore, the overload relief system may activate. During such activation the energy stored within the system may be suddenly released, which may result in an impulse force being applied through the connector 10. In conventional connectors such an impulse force could inadvertently cause the connector to release from the tool 12, which way cause this to be dropped into the wellbore. As will be described in detail below, the connector 10 of the present invention, however, advantageously assists to prevent such inadvertent release of an object in this situation.

Figure 2A:
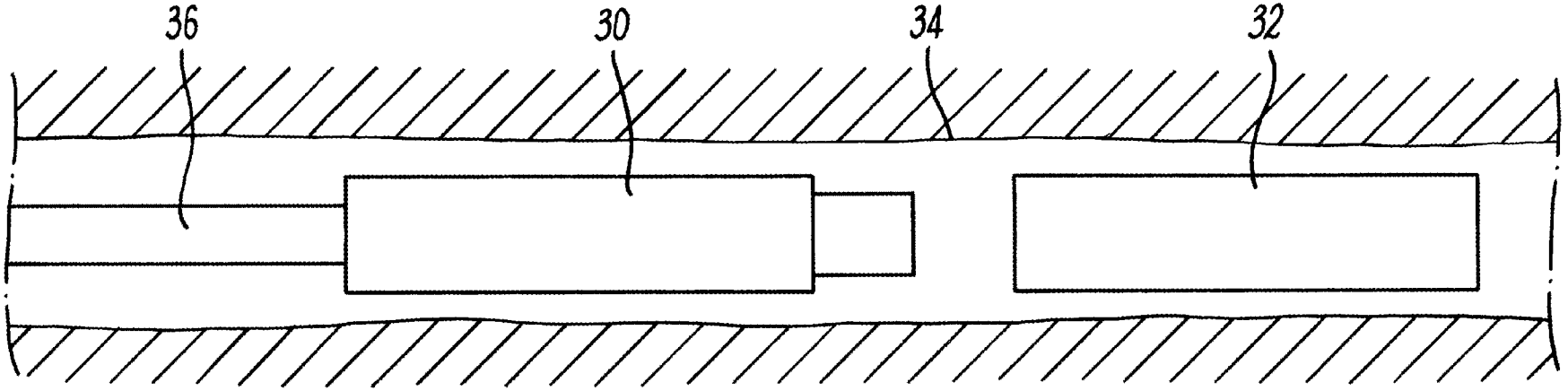
FIGS. 2A and 2B are diagrammatic illustrations of a releasable connector apparatus in accordance with an embodiment of the present invention, shown in sequential stages of operation within an alternative exemplary application.
Figure 2B:
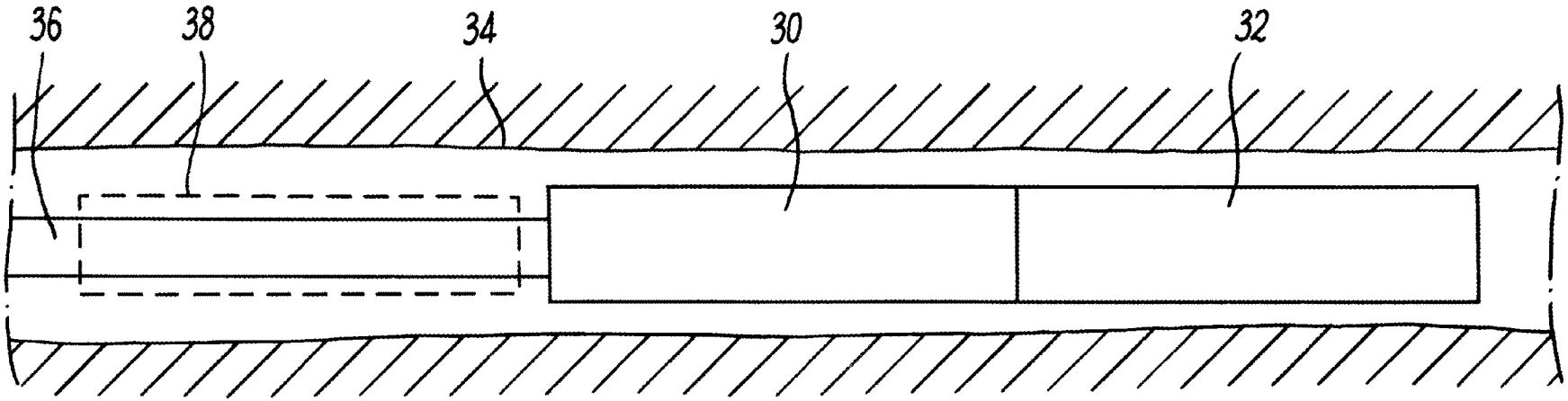

An alternative use of a connector according to the present invention is illustrated in FIGS. 2A and 2B. In this case a connector 30 according to any embodiment of the present invention is used to retrieve or fish an object, such as downhole tool 32, from a wellbore 34. In such a case the connector 30 may be provided in conjunction with or form part of a pulling or fishing tool.

As illustrated in FIG. 2A the connector 30 is run into the wellbore 34 on a deployment member, such as wireline 36, to reach the depth of the tool 32 which is to be retrieved. The connector 30 is stabbed into the tool, which may include a fishing neck or profile, to make a connection, as shown in FIG. 2B. In some cases it may be advantageous to be able to apply a series of jarring forces to the tool 32, for example to assist to free this from the bore 34. Such a jarring force, which is often applied in reverse directions, may be achieved by appropriate manipulation via the deployment member 36. In some cases a dedicated jarring tool 38, shown in broken outline in FIG. 2B, may be used. However, in known connectors the application of a jarring force, especially in reverse directions, may actually cause the connector to release the object, which is undesirable. The present invention permits such a jarring force, or other appropriate manipulation operation, to be achieved while maintaining the connection with the object.

Figure 3A:
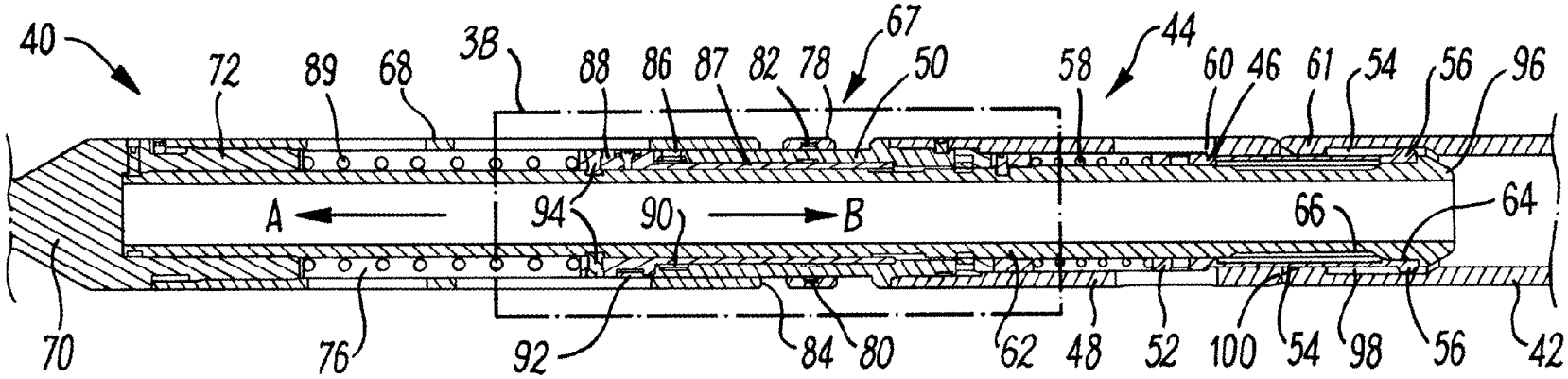
FIG. 3A is a cross-sectional view of a releasable connector apparatus in accordance with an embodiment of the present invention, shown coupled with an object and presented in an initial configuration.
Figure 3C:
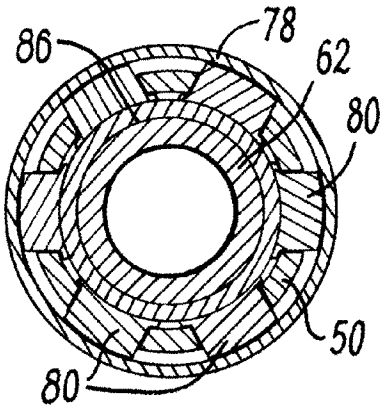
FIG. 3C is a cross-sectional view taken through line 3C-3C of FIG. 3B.
Figure 3B:
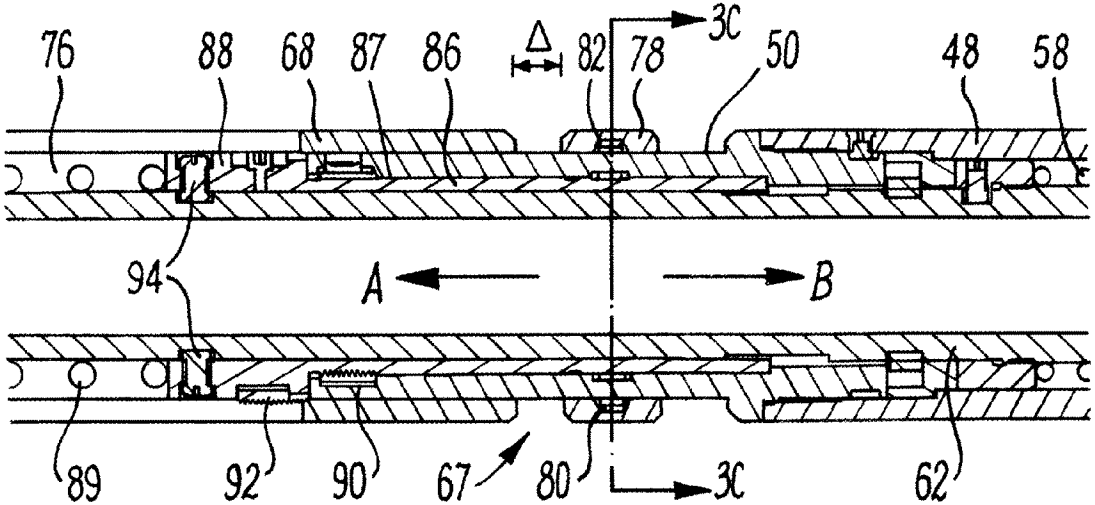
FIG. 3B is an enlarged view of region 3B in FIG. 3A.

Reference is now made to FIGS. 3A, 3B and 3C. FIG. 3A provides a cross-sectional illustration of a releasable connector apparatus, generally identified by reference numeral 40, according to an exemplary embodiment of the present invention. FIG. 3B provides an enlarged view of region 3B of the apparatus in FIG. 3A, and FIG. 3C provides a sectional view through line 3C-3C of FIG. 3B.

The connector apparatus 40 is illustrated in an initial configuration, and being connected with an object such as a downhole tool 42. The connector apparatus 40 comprises a connector assembly, generally identified by reference numeral 44, which includes a collet sleeve 46 mounted within a connector body 48 which in turn is threadedly secured to a limit mandrel 50. The collet sleeve 46 includes a base ring 52 and a plurality of connector members in the form of collet fingers 54 axially extending from the base ring 52, wherein the free or distal end of each collet finger 54 includes a collet barb 56. The collet sleeve 46 is biased by spring 58 in a direction to axially extend the collet fingers 54 from the end of the connector body 48, wherein the collet sleeve 46 is limited in this direction by engagement of the base ring 52 with a limit profile region 60 formed on the inner surface of the connector body 48.

The collet fingers 54 are radially moveable, by bending of the fingers 54 relative to the base ring 52, from a radially extended position, as shown in FIG. 3A, to a radially retracted position. When in the radially extended position the collet barbs 56 are positioned to engage an upset profile 61 formed on the tool 42 to retain connection with the tool. When in the radially retracted position the collet barbs 56 become misaligned from the upset profile 61 of the tool 42, thus permitting connection with the tool 42 to be made and broken. The collet fingers 54 are moved towards their retracted position upon engagement with the upset profile 61. However, as will be described in detail below, the collet fingers 54 may be selectively locked in the extended position such that disconnection with the tool 42 may not be possible until the collet fingers 54 are unlocked.

The connector apparatus 40 further comprises a connector mandrel 62 which extends axially through the connector assembly 44. The connector mandrel 62 includes a circumferential support surface 64 and an axially adjacent circumferential recess 66. In the configuration shown in FIG. 3A the connector mandrel 62 and collet sleeve 46 are relatively positioned such that the distal ends of the collet fingers 54 are supported by the support surface 64. Thus, in this configuration the collet fingers 54 are locked in their radially extended position. As will be described in more detail below, the connector mandrel 62 may be moved axially relative to the collet sleeve 46 so that the distal ends of the collet fingers 54 become aligned with the circumferential recess 66 and desupported, thus permitting the collet fingers 54 to be deflected towards their retracted position.

The apparatus includes a limit arrangement 67 which is activated to permit the connector mandrel 62 to be moved over a first range of movement over which alignment of the support surface 64 with the collet fingers 54 is maintained. The limit arrangement 67 may be subsequently deactivated following a predetermined sequence of movement of the connector mandrel 62 within this first range of movement to permit movement of the connector mandrel 62 beyond the first range and allow the collet fingers 54 to become aligned with the circumferential recess 66, and facilitate disconnection from the tool 42. As such, disconnection from the tool 42 may only be permitted following moving the connector mandrel 62 in the predetermined sequence. In the present embodiment the predetermined sequence of movement includes multiple cycles of movement of the connector mandrel in reverse axial directions.

The ability to move the connector mandrel 62 over the first range and in this predetermined sequence while still maintaining connection with the tool 42 may provide significant advantages. For example, the required sequence of movement of the connector mandrel 62 may minimise the risk of inadvertent or premature disconnection from the tool 42. Further, the movement of the connector mandrel 62 may allow a jarring force to be applied to the tool via the connector apparatus 40, while minimising the risk of the jarring force causing disconnection from the tool 42.

The apparatus 40 further comprises a limit sleeve 68 which is concentrically mounted externally of the connector mandrel 62, and secured to said connector mandrel 62 via a connector sub 70. The connector sub 70 includes a cylindrical portion 72 having an internal thread engaged with a corresponding thread on the outer surface of the connector mandrel 62. The cylindrical portion 72 further includes an external thread engaged with a corresponding thread on the inner surface of the limit sleeve 68. The connector sub 70 may facilitate connection of the apparatus 40 to a further component, such as to a deployment member (not show), for example wireline, coiled tubing or the like. For example, the connector sub may comprise a rope socket or the like.

The limit sleeve 68 extends over an end of the limit mandrel 50 of the connector assembly 44, such that the limit mandrel 50 is positioned within an annular gap 76 between the connector mandrel 62 and the limit sleeve 68.

The apparatus 40, and in particular the limit arrangement 67 of the apparatus 40 includes an annular abutment member 78 which is mounted on the outer surface of the limit mandrel 50 of the connector assembly 44. In the initial configuration shown, in which the limit arrangement 67 is activated, the abutment member is secured at a fixed position on the limit mandrel 50 by a plurality of keys 80 which extend radially through the limit mandrel 50 from an inner surface thereof to engage within a circumferential recess 82 on the inner surface of the abutment member. As such, in this configuration the abutment member 78 is axially fixed to the limit mandrel 50.

In the illustrated initial configuration the abutment member 78 and the axial end face 84 of the limit sleeve 68 are axially separated by a maximum distance A. This distance A may be adjusted by adjustment of the limit sleeve 68 via its threaded connection with the connector sub 70. As will be described in further detail below, in use, the connector mandrel 62, and thus limit sleeve 68 may be axially stroked by distance A until the end face 84 of the limit sleeve 68 abuts the abutment member 78, thus defining a limit of movement of the connector mandrel 62. In this respect the distance A is selected such that the collet fingers 54 of the collet sleeve 46 always remain supported by the support surface 64 of the connector mandrel 62, at least until the limit arrangement 67 is deactivated. Once fully stroked until engagement with the abutment member 78 is achieved, the connector mandrel 62 may then be axially returned by the same distance A. The connector mandrel 62 may be axially reciprocated in this manner until the limit arrangement becomes deactivated such that eventually the connector mandrel 62 will be permitted to move beyond distance A and permit the collet fingers 54 to become aligned with the recess 66 in the collet mandrel 62.

The apparatus 40 further comprises a support sleeve 86 which includes a first cylindrical portion 87 which is radially interposed between the connector mandrel 62 and the limit mandrel 50, and in the initial configuration shown radially supports the keys 80 to thus retain the connection of the abutment member 78 with the limit mandrel 50. The support sleeve further includes an enlarged second cylindrical portion 88 which is radially interposed between the connector mandrel 62 and the limit sleeve 68. A spring 89 extends in the annular gap 76 between the connector mandrel 62 and limit sleeve 68 and acts between the connector sub 70 and the support sleeve 86.

A first ratchet member 90 is mounted on the inner surface of the limit mandrel 50 and is arranged to cooperate with a ratchet profile formed on the outer surface of the first cylindrical portion 87. The first ratchet member 90 functions to permit movement of the support sleeve 86 in the direction of arrow A relative to the limit mandrel 50, and prevent movement of the support sleeve 86 in the opposite direction (illustrated by arrow B). Further, a second ratchet member 92 is mounted on the outer surface of the second cylindrical portion 88 and is arranged to cooperate with a ratchet profile formed on the inner surface of the limit sleeve 68. The second ratchet member 92 functions to permit movement of the limit sleeve 68 and thus connector mandrel 62 relative to the support sleeve 86 in the direction of arrow B, and prevent relative movement of the limit sleeve 68 and support sleeve 86 in the opposite direction (arrow A).

The support sleeve is initially secured to the connector mandrel via a plurality of shear screws 94.

The operation of the connector apparatus 40 will now be described in detail.

The apparatus 40 is initially configured as shown in FIG. 3A. To engage a tool 42 the end 96 of the connector mandrel 62 is inserted into an appropriate socket 98 of the tool 42 such that engagement of the collet sleeve 46 with the upset profile 61 of the tool 42 moves said collet sleeve against the bias of spring 58. This movement causes the collet fingers 54 to be aligned with the recess 66 in the connector mandrel 62, such that the collet fingers 54 may be deflected radially inwards by engagement with the upset profile 61, allowing the collet barbs 56 to pass the upset profile 61, and be received within the socket 98. At this point the spring 58 returns the collet sleeve 46 such that the collet fingers 54 become supported by support surface 64. In this configuration the apparatus 40 is connected with the tool 42.

Figure 4:
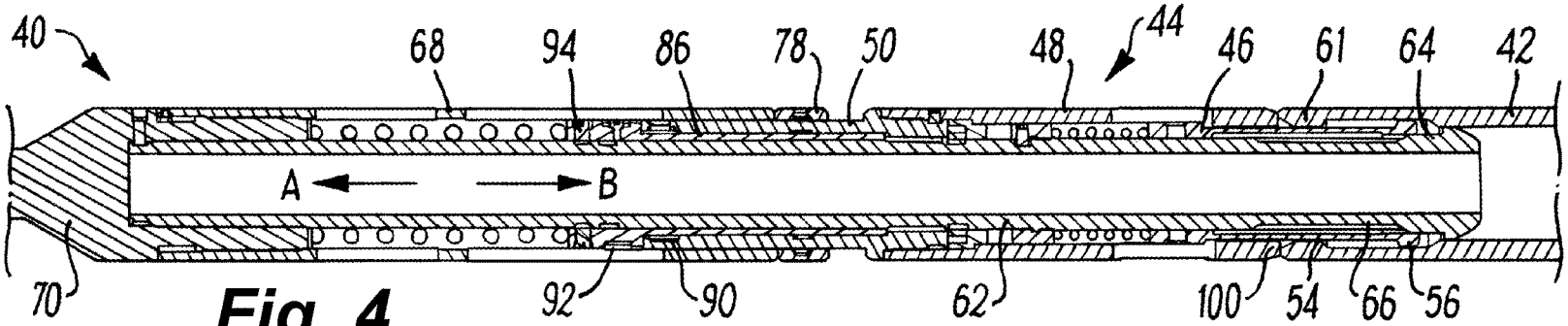
FIGS. 4 to 9 show the apparatus of FIG. 3A in sequential stages of operation to permit release from the object.

Once connection is made, it may be desirable to move the connector mandrel in a desired manner. Such movement may be desired to provide a function, such as a jarring function. Alternatively, such movement may be desired to eventually permit disconnection from the tool 42. In this respect, as shown in FIG. 4, the lower end face 100 of the connector body 48 is engaged against the upset profile 61 of the tool 42, and a downward force, in the direction of arrow B, may be applied to the connector mandrel 62 to cause the shear screws 94 to shear, permitting the connector mandrel 62 to move downwardly relative to the connector assembly 44 until the limit sleeve 68 abuts the abutment member 78. Such downward movement of the connector mandrel 62 is permitted due to the arrangement of the second ratchet member 92 which permits relative movement of the connector mandrel 62 and limit sleeve 68 in this direction B. At this maximum permitted movement of the connector mandrel 62 the collet fingers 54 remain aligned and supported by the support surface 64, and as such the connection with the tool 42 may be maintained.

Figure 5:
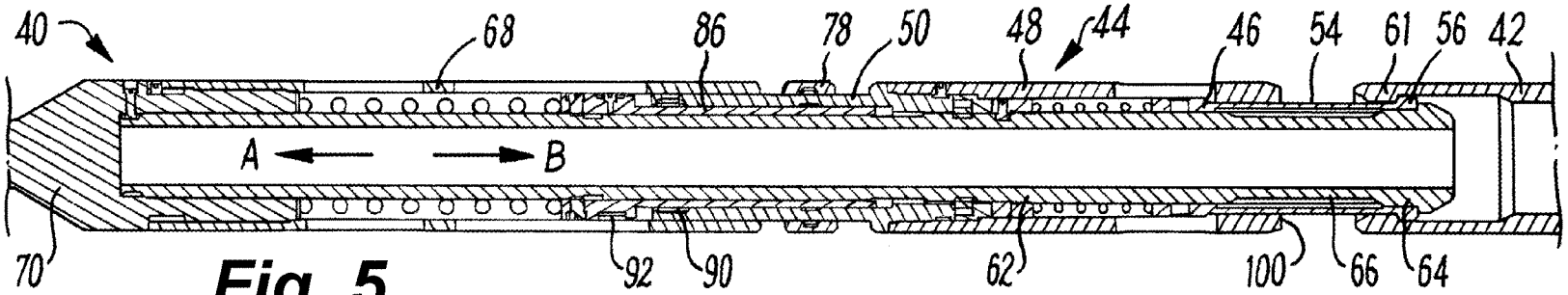

Subsequent to this, as shown in FIG. 5, the connector mandrel 62 may be pulled upwardly, in the direction of arrow A, which lifts the entire apparatus 40 until the collet barbs 56 engage the upset profile 61 on the tool 42. At this point the connector mandrel 62 may be moved upwardly in the direction of arrow A relative to the connector assembly 44, opening the gap between the limit sleeve 68 and abutment member 78. During such upward movement the second ratchet member 92 causes the support sleeve 86 to become coupled to the limit sleeve 68, such that the support sleeve 86 is also moved upwardly with the connector mandrel 62. In this respect, such upward movement of the support sleeve 86 relative to the limit mandrel 50 is permitted by the first ratchet member 90. This arrangement thus causes the support sleeve 86 to be moved in the direction of arrow A relative to the limit mandrel.

Figure 6:
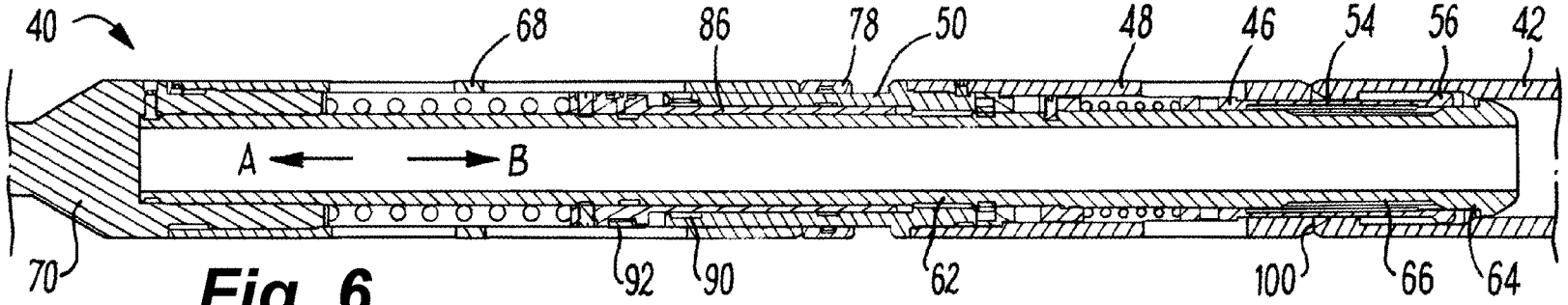

As shown in FIG. 6, a downward force may then again be applied to the connector mandrel 62, moving the entire apparatus 40 down in the direction of arrow A until the end face 100 of the connector body 48 is again engaged with the upset profile 61 of the tool 42. As the connector assembly 44 is now reacted off the tool 42 the connector mandrel 62 may be moved downwardly in the direction of arrow A relative to the connector assembly 44 until the limit sleeve 68 again abuts the abutment member 78. As before, such downward movement is permitted by the second ratchet member 92. Further, the first ratchet member 90 axially locks the support sleeve 86 relative to the limit mandrel 50 such that the support sleeve 86 is prevented from moving in the direction of arrow B. Again, the permitted movement of the connector mandrel is insufficient to allow the collet fingers 54 to become aligned with the recess 66 in the connector mandrel 62, thus allowing the connection with the tool 42 to be maintained.

Figure 7:
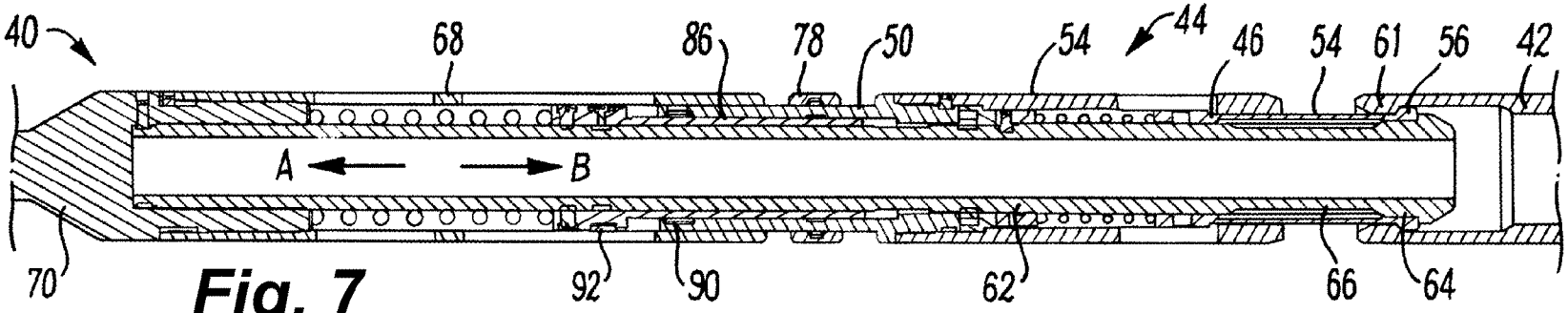

Following this, as shown in FIG. 7, an upward force is again be applied via the connector mandrel 62, pulling the entire apparatus 40 upwardly until the collet barbs 56 engage with the upset profile 61 of the tool 42, and causing the gap between the limit sleeve 68 and abutment member 78 to again open. Further, such upward movement of the connector mandrel 62 and limit sleeve 68 causes the support sleeve 86 to be moved further in the direction of arrow A relative to the limit mandrel, by action of the ratchet members 90, 92.

Figure 8:
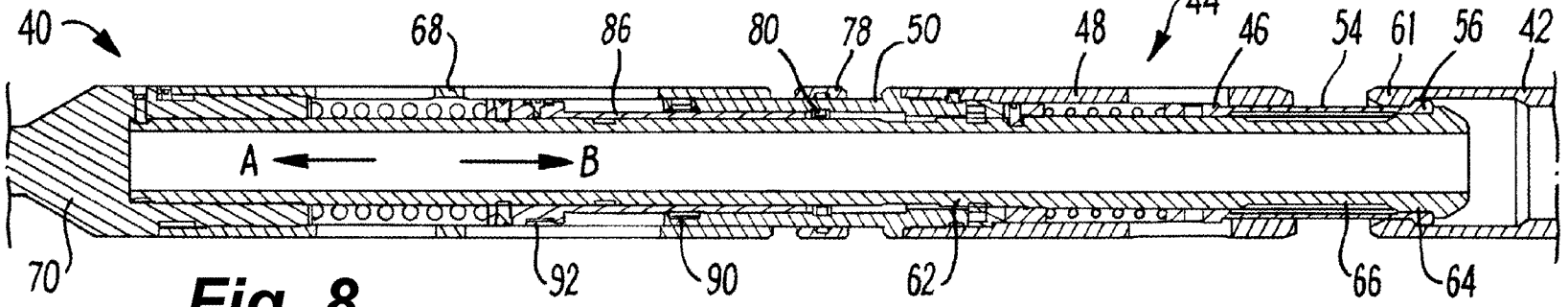
Figure 9:
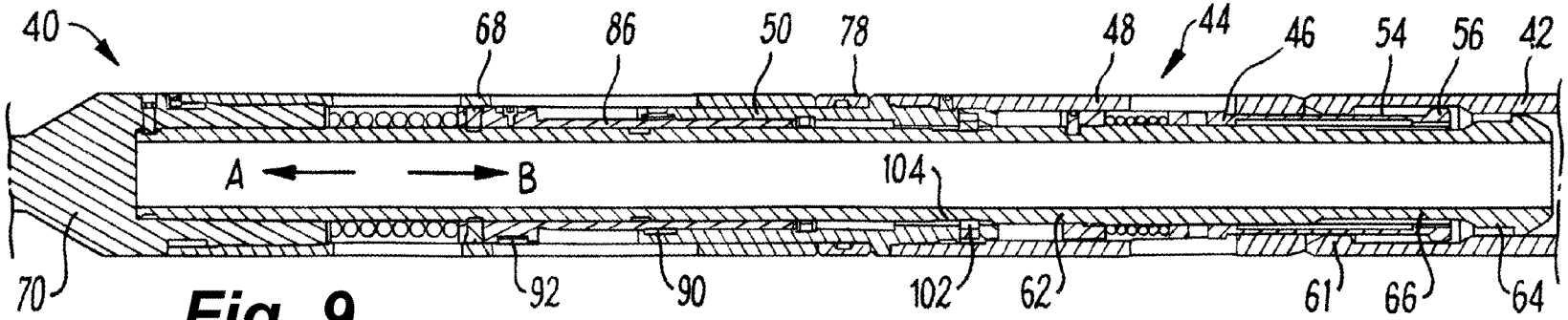

This cycle of downward and upward movements of the connector mandrel 62 may be repeated until such time as the support sleeve 86 is moved by a sufficient distance to cause the keys 80 which secure the abutment member 86 to the limit mandrel 50 to become unsupported, as illustrated in FIG. 8. A subsequent downward movement of the connector mandrel, as illustrated in FIG. 9, may therefore cause the limit sleeve 68 to abut the abutment member 78 and cause this to slide downwardly, in the direction of arrow B, on the limit mandrel 50, thus allowing the connector mandrel 62 to move further than previously permitted. As such, the collet fingers 54 may now be aligned with the recess 66 in the connector mandrel, such that the fingers 54 may be deflected radially inwardly upon engagement with the upset profile 61 of the tool 42 to permit disconnection.

Further, once the connector mandrel 62 has been moved the appropriate distance to desupport the collet fingers 54 a snap ring 102 becomes engaged within a further recess 104 formed on the outer surface of the connector mandrel 62, to thus lock the connector mandrel 62 in this position.

In the embodiment described above, the apparatus 40 includes a connector sub 70 which provides connection with a deployment member, such as wireline or coiled tubing. In some embodiments the apparatus may be provided also in combination with a jarring tool, which may provide a linear jarring force to the tool 42 via the connector apparatus 40. The ability of the connector mandrel to be reciprocated a number of cycles while maintaining the connection may facilitate advantageous use in a jarring operation.

Figure 10:
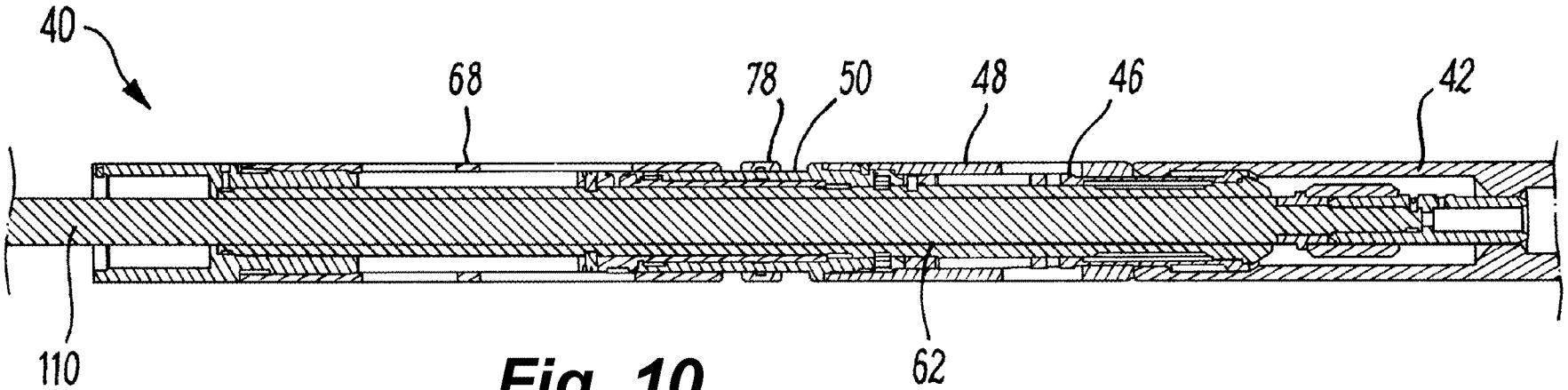
FIG. 10 is a cross-sectional view of a releasable connector apparatus in accordance with an alternative embodiment of the present invention.

Further, as shown in FIG. 10, the apparatus 40 may be configured for use with a setting tool which includes an elongate actuator 110 which extends through the connector mandrel 62 to engage and actuate a connected tool 42.

It should be understood that the embodiments described herein are merely exemplary and that various modifications may be made thereto without departing from the scope of the invention.

The invention claimed is:

1. A releasable connector apparatus, comprising:

a sleeve mounted in a connector body, the connector body being threadedly secured to a limit mandrel and the sleeve including a connector member which is moveable between connection and disconnection configurations to facilitate a releasable connection with an object;

a connector mandrel extending axially through the sleeve and comprising a circumferential support surface and an axially adjacent circumferential recess, the connector mandrel being movable relative to the sleeve such that alignment of the circumferential support surface and the connector member locks said connector member in its connected configuration with the connector member supported by the connector mandrel, and alignment of the adjacent circumferential recess and the connector member permits the connector member to be moved towards its disconnected configuration; and a limit arrangement configurable from an activated state in which movement of the connector mandrel is limited to a first range of movement over which alignment of the circumferential support surface with the connector member is maintained, to a deactivated state in which movement of the connector mandrel is permitted beyond the first range of movement to allow alignment of the adjacent circumferential recess and the connector member;

wherein the limit arrangement comprises an annular abutment member mounted on an outer surface of the limit mandrel for physically limiting movement of the connector mandrel within the first range of movement.

2. The releasable connector apparatus according to claim 1, wherein the connector mandrel is movable relative to the sleeve in one or more directions of movement.

3. The releasable connector apparatus according to claim 1, wherein the connector mandrel is movable relative to the sleeve in reverse or opposing directions of movement.

4. The releasable connector apparatus according to claim 1, wherein the limit arrangement, when activated, limits movement of the connector mandrel relative to the sleeve in at least one direction, wherein said at least one direction includes a direction in which the connector mandrel is required to be moved to misalign the circumferential support surface and connector member.

5. The releasable connector apparatus according to claim 1, wherein the limit arrangement is configurable from its activated state to its deactivated state following a predetermined sequence of movement of the connector mandrel within the first range of movement.

6. The releasable connector apparatus according to claim 5, wherein the predetermined sequence of movement of the connector mandrel to permit reconfiguration of the limit arrangement to its deactivated state includes movement in multiple directions within or over the first range of movement.

7. The releasable connector apparatus according to claim 5, wherein the predetermined sequence of movement of the connector mandrel to permit reconfiguration of the limit arrangement to its deactivated state includes movement in reverse directions.

8. The releasable connector apparatus according to claim 5, wherein the apparatus is adjustable such that a required number of discrete movements within the predetermined sequence is adjustable.

9. The releasable connector apparatus according to claim 5, wherein the apparatus is adjustable such that the first range of movement is adjustable.

10. The releasable connector apparatus according to claim 1, wherein the annular abutment member is mounted coaxially relative to the connector mandrel.

11. The releasable connector apparatus according to claim 1, wherein the annular abutment member is secured at a fixed location when the limit arrangement is activated, and released from the fixed location to deactivate the limit arrangement.

12. The releasable connector apparatus according to claim 11, wherein the annular abutment member is released from the fixed location following a predetermined sequence of movement of the connector mandrel.

13. The releasable connector apparatus according to claim 1, wherein the annular abutment member is rigidly fixed to the sleeve when the limit arrangement is activated, and released from the sleeve to deactivate the limit arrangement.

14. The releasable connector apparatus according to claim 13, wherein the annular abutment member is permitted to slide relative to the sleeve over a distance which permits the connector mandrel to move beyond the first range of movement when said annular abutment member is released.

15. The releasable connector apparatus according to claim 1, further comprising a limit sleeve coupled to the connector mandrel, wherein the limit sleeve is arranged to abut the annular abutment member.

16. The releasable connector apparatus according to claim 15, wherein the limit sleeve is coaxially mounted relative to the connector mandrel, and the sleeve is radially interposed between the connector mandrel and the limit sleeve.

17. The releasable connector apparatus according to claim 15, wherein the limit sleeve is adjustable relative to the connector mandrel to provide for adjustment of the first range of movement.

18. The releasable connector apparatus according to claim 1, further comprising a limit mandrel, upon which the annular abutment member is mounted, wherein the limit mandrel is secured to or forms part of the sleeve.

19. The releasable connector apparatus according to claim 18, wherein the annular abutment member is located on one radial side of the limit mandrel, and the at least one locking member extends through the limit mandrel from an opposing radial side of the limit mandrel to engage the annular abutment member.

20. The releasable connector apparatus according to claim 19, wherein at least a portion of the support member is radially interposed between the connector mandrel and the limit mandrel of the sleeve.

21. The releasable connector apparatus according to claim 1, wherein the limit arrangement comprises at least one locking member configured to engage the annular abutment member and secure said annular abutment member at a fixed location when the limit arrangement is in its activated state, and to disengage the annular abutment member to deactivate the limit arrangement and permit the annular abutment member to be released from the fixed location.

22. The releasable connector apparatus according to claim 21, further comprising a support member movable from a supporting position in which the at least one locking member is supported and held in engagement with the annular abutment member, to a desupporting position in which the at least one locking member is unsupported and permitted to disengage the annular abutment member.

23. The releasable connector apparatus according to claim 22, wherein the support member is movable between the supporting and desupporting positions by a predetermined sequence of movement of the connector mandrel.

24. The releasable connector apparatus according to claim 23, wherein the predetermined sequence of movement of the connector mandrel includes at least two sequential discrete movements in reverse directions, wherein the apparatus is configured such that the support member is moved or driven one discrete step only in response to movement of the connector mandrel in one of the reverse directions.

25. The releasable connector apparatus according to claim 22, wherein the connector mandrel and the support member are coupled together via a uni-directional coupling arrangement configured to permit the support member to be moved only in response to movement of the connector mandrel in one direction.

26. The releasable connector apparatus according to claim 25, wherein the uni-directional coupling arrangement couples the support member to the connector mandrel when the connector mandrel is moved in a first direction, and decouples the support member from the connector mandrel when the connector mandrel is moved in a second direction which is opposite the first direction.

27. The releasable connector apparatus according to claim 25, wherein the uni-directional coupling arrangement comprises a ratchet arrangement.

28. The releasable connector apparatus according to claim 27, wherein the ratchet arrangement comprises a first ratchet assembly for providing a ratchet connection between the support member and the connector mandrel for drivingly coupling the connector mandrel and the support member together when the connector mandrel is moved in a first direction, and uncouple the connector mandrel and the support member when the connector mandrel is moved in a second, opposite direction.

29. The releasable connector apparatus according to claim 28, wherein the ratchet arrangement comprises a second ratchet assembly for providing a ratchet connection between the support member and the sleeve.

30. The releasable connector apparatus according to claim 29, wherein the first and second ratchet assemblies operate in reverse directions to permit discrete movement steps of the support member to be achieved by movement of the connector mandrel in a single direction.

31. The releasable connector apparatus according to claim 22, wherein the connector mandrel and support member are initially coupled together by a releasable connection configured to be released by application of a predetermined force via the connector mandrel.

32. The releasable connector apparatus according to claim 1, further comprising a locking arrangement configured to lock the connector mandrel relative to the sleeve when the connector mandrel has moved beyond the first range of movement following deactivation of the limit arrangement.

33. The releasable connector apparatus according to claim 1, wherein the sleeve comprises a collet, wherein the connector member defines a collet finger.

34. The releasable connector apparatus according to claim 1, wherein the sleeve comprises a connector body, and the connector member is mounted relative to the connector body.

35. The releasable connector apparatus according to claim 34, wherein the connector member is axially movable relative to the connector body between axial limits of movement defined by the connector body.

36. The releasable connector apparatus according to claim 35, wherein the connector member is biased towards one axial limit of movement within the connector body.

37. The releasable connector apparatus according to claim 36, wherein the connector member is movable against the bias to temporarily disengage or misalign the connector member from the circumferential support surface of the connector mandrel to permit said connector member to be moved towards a retracted position and permit connection with the object to be achieved.

38. The releasable connector apparatus according to claim 1, wherein the connector mandrel defines a stepped region adjacent the circumferential support surface, wherein relative movement of the connector mandrel beyond the first range of movement permits the stepped region to become aligned with the connector member, thus permitting the connector member to be moved towards a retracted position into the stepped region.

39. The releasable connector apparatus according to claim 1, wherein the connector mandrel defines an axial through bore for accommodating an elongate member therethrough.

40. A releasable connector apparatus, comprising:

a sleeve mounted in a connector body, the connector body being threadedly secured to a limit mandrel and the sleeve including a connector member which is moveable between connection and disconnection configurations to facilitate a releasable connection with an object;

a connector mandrel extending axially through the sleeve and comprising a circumferential support surface and an axially adjacent circumferential recess, the connector mandrel being movable relative to the sleeve such that alignment of the circumferential support surface and the connector member locks said connector member in its connected configuration with the connector member supported by the connector mandrel, and alignment of the adjacent circumferential recess and the connector member permits the connector member to be moved towards its disconnected configuration;

a limit sleeve coupled to the connector mandrel; and a limit arrangement configurable from an activated state in which movement of the connector mandrel is limited to a first range of movement over which alignment of the circumferential support surface with the connector member is maintained, to a deactivated state in which movement of the connector mandrel is permitted beyond the first range of movement to allow alignment of the adjacent circumferential recess and the connector member;

wherein the limit arrangement is configurable from its activated state to its deactivated state following a predetermined sequence of movement of the connector mandrel within the first range of movement;

wherein the limit arrangement comprises an annular abutment member mounted on an outer surface of the limit mandrel for physically limiting movement of the connector mandrel within the first range of movement;

wherein the limit sleeve is arranged to abut the annular abutment member;

wherein the limit sleeve is adjustable relative to the connector mandrel to provide for adjustment of the first range of movement.

* * * * *